US006702979B2

(12) United States Patent
Parra Muñoz

(10) Patent No.: US 6,702,979 B2
(45) Date of Patent: Mar. 9, 2004

(54) METHOD FOR PRODUCING SPECIAL CERAMIC PARTS

(75) Inventor: Cleto Parra Muñoz, Onda (ES)

(73) Assignee: Cibis Ceramicas, S.l., Onda (ES)

( * ) Notice: Subject to any disclaimer, the term of this patent is extended or adjusted under 35 U.S.C. 154(b) by 0 days.

(21) Appl. No.: 10/182,928

(22) PCT Filed: Dec. 28, 2000

(86) PCT No.: PCT/ES00/00494

§ 371 (c)(1),
(2), (4) Date: Aug. 5, 2002

(87) PCT Pub. No.: WO01/57337

PCT Pub. Date: Aug. 9, 2001

(65) Prior Publication Data

US 2003/0001319 A1 Jan. 2, 2003

(30) Foreign Application Priority Data

Feb. 7, 2000 (ES) ..... P200000261

(51) Int. Cl.[7] ..... B28B 3/20
(52) U.S. Cl. ..... 264/638; 264/643
(58) Field of Search ..... 264/638, 643

(56) References Cited

U.S. PATENT DOCUMENTS 3,832,112 A * 8/1974 Dye
5,982,169 A * 11/1999 Furlani et al.

* cited by examiner

*Primary Examiner*—Christopher A. Fiorilla
(74) *Attorney, Agent, or Firm*—Klauber & Jackson

(57) ABSTRACT

The invention concerns a method for producing special ceramic parts essentially having a curved or angular structure to cover the corners of walls that are in turn covered by other parts or flat tiles. The method basically involves extruding a tubular profile from which different special parts are obtained by making different cuts on said tubular profile using an adequate cutting tool. A pressing system is currently used requiring costly molds to manufacture individual special parts.

4 Claims, 2 Drawing Sheets

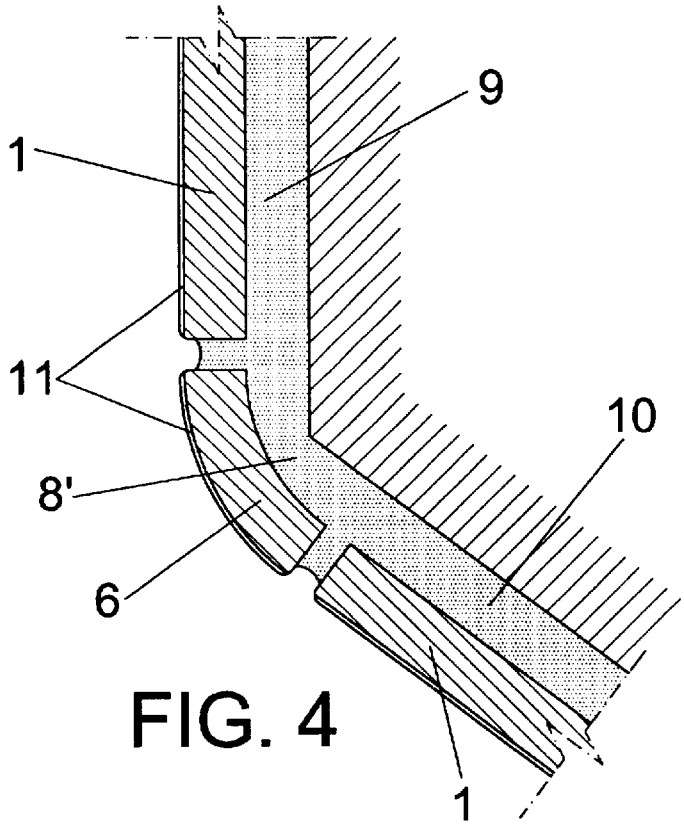
FIG. 4
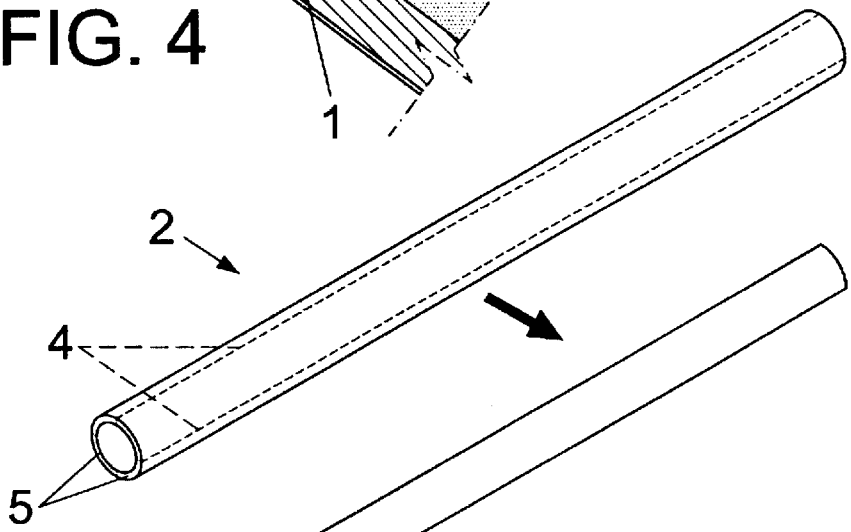
FIG. 5
FIG. 6
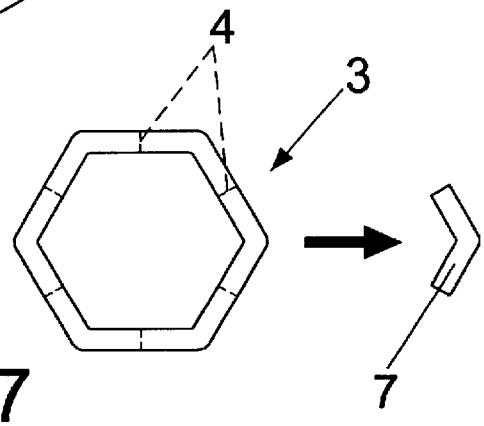
FIG. 7

METHOD FOR PRODUCING SPECIAL CERAMIC PARTS

This application is a 371 of PCT/ES00/00494 filed Dec. 28, 2000.

OBJECT OF THE INVENTION

As expressed in the title of this specification, the present invention refers to a new method for manufacturing special ceramic pieces.

It permits the obtainment of ceramic pieces for ceramic coverings with qualities superior to the ones existing at this time.

The method basically consists of manufacturing by extrusion a tube-shaped profile from which the different special pieces are obtained and of making some appropriate cuts by means of the appropriate tool.

BACKGROUND OF THE INVENTION

Nowadays ceramic coating or covering of walls is not only limited to the use of the classic tiles of a uniform format (square, rectangular, etc.) used to cover more or less flat surfaces.

Complementary pieces whose purpose is to obtain better finishes have also been developed and the one used to finish corners that have a curved or arched shape preferably stands out.

Hence, it is a piece whose section has the approximate shape of a circular crown sector.

Normally this piece has a length equal to that of the tiles used in the covering and it is placed on the corner of the wall covering the hollow space left by the facing of the tiles.

It is a very narrow piece, for which reason it is not possible to manufacture it by spreading ceramic paste, since from a certain length deformations that would undoubtedly spoil the linearity and continuity thereof would be produced.

These technical conditions require the ceramic support of a piece to be manufactured as if it were a ceramic tile, in other words, by pressing and subsequent enameling and baking.

On the other hand, the pressing process requires molds whose dimensions will obviously limit the dimensions of the piece to be obtained.

This fact also implies another added problem, since the formats of ceramic pieces are ever increasing and this requires new and costly molds to be made in order to obtain this special piece that has the arched shape or other different shapes of flat tiles.

DESCRIPTION OF THE INVENTION

In order to overcome the problems and inconveniences mentioned in the preceding section, the invention proposes a new method for manufacturing special ceramic pieces in such a way that from a conventional ceramic paste, similar to the one used in the manufacture of ceramic tiles, a preferably cylindrical tube-shaped profile is obtained by extrusion. Subsequently this profile is subjected to firing in order to achieve the vitrification thereof which provides it a hardness similar to the one of a conventional tile.

Once we have the baked ceramic bisque tube or profile it is then cut by means of specific tools.

Normally four longitudinal cuts will be made in order to obtain four pieces applicable to corners, whose angle is approximately 90°, although the number of cuts can vary in order to obtain different angular measurements larger or smaller than 90°.

Once the curved segments are obtained, they will be enameled on one of their surfaces and subjected to the corresponding baking in order to vitrify the enamel, as conventionally done in the manufacture of tiles.

In this way, we obtain totally linear pieces of the desired length.

The key to the success of this new method or process lies on the fact that extrusion of the tube-shaped body is substantially stabler than that of an open profile in which the inside stresses deform it more easily.

Hereinafter to provide a better understanding of this specification and forming an integral part thereof, some figures in which the object of the invention has been represented in an illustrative and non-restrictive manner are attached.

BRIEF DESCRIPTION OF THE DRAWINGS

FIG. 4 represents a view similar to the preceding one wherein the corner where the two walls converge forms an angle larger than 90°.

FIG. 5 represents a perspective view of a cylindrical-tube-shaped body obtained by extrusion like the one represented in FIG. 1.

FIG. 6 represents a perspective view of an elongated piece with a curved shape obtained from the body represented in the preceding figure.

FIG. 7 represents a front view of a tube-shaped body obtained by extrusion like in the case of the body of FIG. 1, the body having a polygonal section of four sides.

DESCRIPTION OF THE PREFERRED EMBODIMENT

Figure 1:
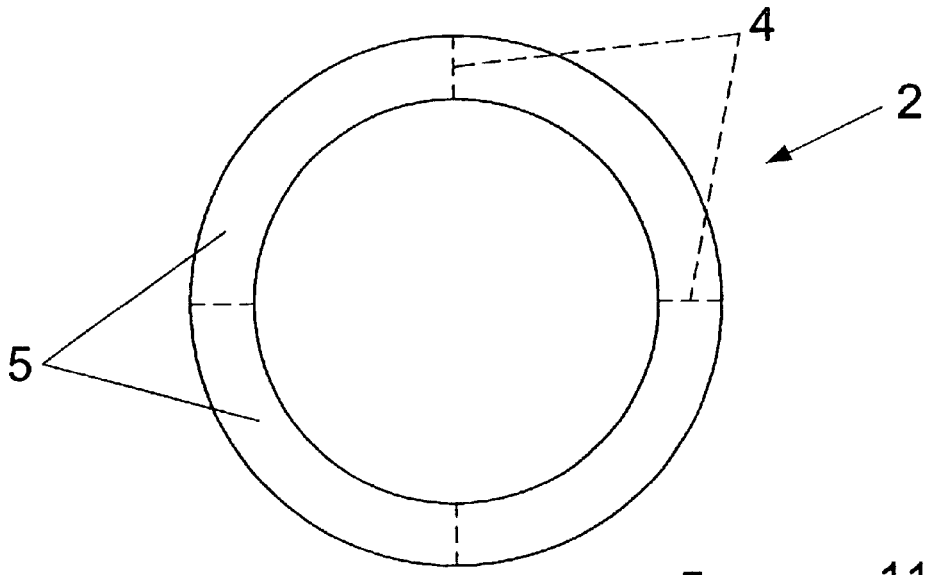
FIG. 1 represents a front view of a tube-shaped body obtained by extrusion that forms part of the method for manufacturing special ceramic pieces. Once said tube-shaped body has been obtained, it will be subjected to firing in order to achieve the vitrification thereof.
Figure 2:
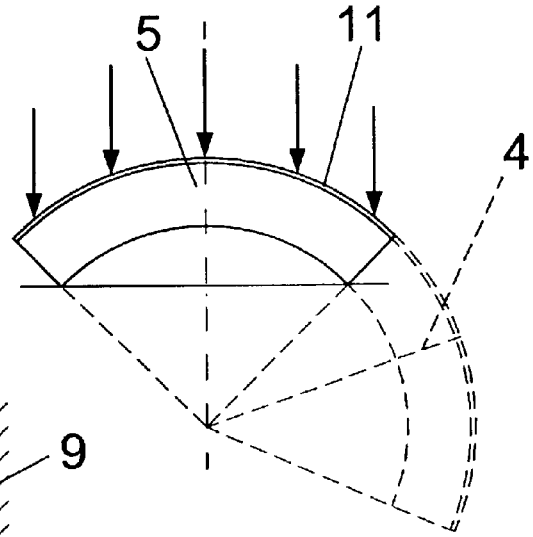
FIG. 2 represents an arched ceramic piece obtained by means of a cutting tool from the tube-shaped body obtained by extrusion of the preceding figure. This arched piece includes enamel on its visible surface.

Making reference to the numbering used in the figures, the method for manufacturing special ceramic pieces comprises the following steps or stages.

Initially, starting with a conventional ceramic paste similar to the one used in the manufacture of ceramic tiles (1), there is a first step in which a tube-shaped profile with a cylindrical (2) section, hexagonal section (3) or any other section is obtained by extrusion.

A second step wherein the tube-shaped profile obtained by extrusion is subjected to firing in order to achieve the vitrification thereof which provides it with a hardness similar to the hardness of a conventional tile (1).

A third step in which a cut (4) is made in the tube-shaped profile of the vitrified bisque by means of a specific tool. Normally, longitudinal cuts that section it into corresponding smaller and smaller special parts or pieces will be made.

Figure 3:
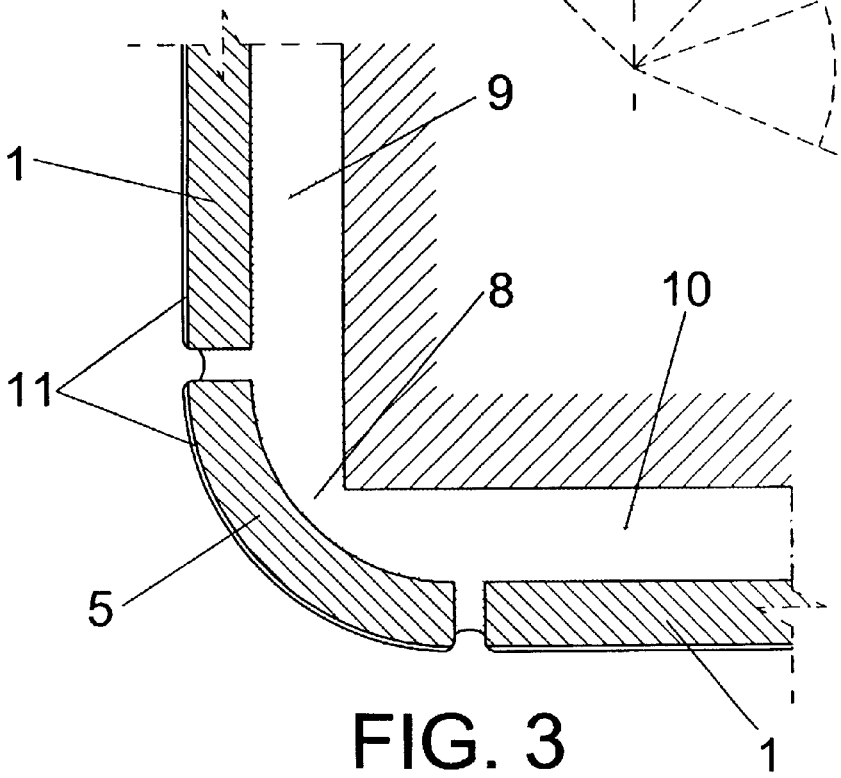
FIG. 3 represents a view of the arched pieces applied to a corner formed by two walls at 90° that are covered by other conventional flat pieces.

Normally four longitudinal cuts will be made in order to obtain four pieces applicable to corners (8), whose angle is approximately 90° (FIGS. 1 and 3), although the number of cuts can vary in order to obtain different angular measurements (FIG. 4). Furthermore, the angle of the corner (8') formed by the walls (9) and (10) can be different from 90° (FIG. 4).

Once the special segments or pieces have been obtained, whether they are curved (5) and (6), angular (7) or the like, in a fourth step the visible surfaces of these special pieces will be coated with enamel (11).

In a subsequent step, the special pieces with enamel will be subjected to firing in order to vitrify the enamel, just as it is usually done when tiles are manufactured.

In this way, we obtain totally linear homogeneous pieces with the desired continuity on their visible surfaces, wherein the desired length can be obtained.

What is claimed is:

1. Method for manufacturing special ceramic pieces, these pieces being of the type that have any shape different from the one of flat ceramic pieces, characterized in that it comprises the following steps:

a first step wherein starting with a ceramic paste a tube-shaped profile is obtained by extrusion;

a second step wherein the tube-shape profile obtained by extrusion is subjected to firing in order to achieve the vitrification thereof that provides it with an adequate degree of hardness;

a third step wherein the vitrified tube-shape profile is cut in order to obtain the special pieces;

a fourth step wherein the visible surfaces of the special pieces will be coated with enamel;

a fifth step wherein the special pieces with enamel will be subjected to firing in order to vitrify the cited enamel.

2. Method for manufacturing special ceramic pieces according to claim 1, characterized in that the tube-shaped profile obtained by extrusion has a curved structure.

3. Method for manufacturing special ceramic pieces according to claim 1, characterized in that the tube-shaped profile obtained by extrusion has a polygonal shape.

4. Method for manufacturing special ceramic pieces according to claim 1, characterized in that the cuts made in the corresponding tube-shaped profile obtained by extrusion are longitudinal cuts.

* * * * *

UNITED STATES PATENT AND TRADEMARK OFFICE

CERTIFICATE OF CORRECTION

PATENT NO. : 6,702,979 B2
DATED : March 9, 2004
INVENTOR(S) : Cleto Parra Munoz

It is certified that error appears in the above-identified patent and that said Letters Patent is hereby corrected as shown below:

Title page,
Item [73], Assignee, please correct from "Cibis Ceramicas, S.L." to read -- Cebis Ceramicas, S.L. --

Signed and Sealed this

Twenty-first Day of December, 2004

JON W. DUDAS
*Director of the United States Patent and Trademark Office*